US009085809B2

(12) United States Patent
Greiveldinger

(10) Patent No.: US 9,085,809 B2
(45) Date of Patent: Jul. 21, 2015

(54) STEAM CONDENSATION TOWER FOR A GRANULATION INSTALLATION

(75) Inventor: Bob Greiveldinger, Frisange (LU)

(73) Assignee: PAUL WURTH S.A., Luxembourg (LU)

( * ) Notice: Subject to any disclaimer, the term of this patent is extended or adjusted under 35 U.S.C. 154(b) by 85 days.

(21) Appl. No.: 13/993,762

(22) PCT Filed: Sep. 30, 2011

(86) PCT No.: PCT/EP2011/067176

§ 371 (c)(1),
(2), (4) Date: Jun. 13, 2013

(87) PCT Pub. No.: WO2012/079797

PCT Pub. Date: Jun. 21, 2012

(65) Prior Publication Data

US 2013/0264754 A1 Oct. 10, 2013

(30) Foreign Application Priority Data

Dec. 14, 2010 (LU) ..... 91765

(51) Int. Cl.

| | |
|---|---|
| ***C21B 3/06*** | (2006.01) |
| ***C21B 3/08*** | (2006.01) |
| ***F27B 1/10*** | (2006.01) |
| ***F27D 15/02*** | (2006.01) |
| ***F28B 3/04*** | (2006.01) |

(52) U.S. Cl.

CPC ... *C21B 3/06* (2013.01); *C21B 3/08* (2013.01); *F27B 1/10* (2013.01); *F27D 15/02* (2013.01); *F27D 15/0286* (2013.01); *F28B 3/04* (2013.01)

(58) Field of Classification Search

CPC ..... C21B 3/06; C21B 3/08
USPC ..... 266/147, 157
See application file for complete search history.

(56) References Cited

U.S. PATENT DOCUMENTS

| | | | | |
|---|---|---|---|---|
| 3,912,487 | A | 10/1975 | Sharanov et al. | |
| 5,540,895 | A * | 7/1996 | Faber et al. | 422/172 |
| 6,000,242 | A * | 12/1999 | George et al. | 65/19 |
| 2007/0107466 | A1 * | 5/2007 | Vuletic | 65/19 |

FOREIGN PATENT DOCUMENTS

| | | | |
|---|---|---|---|
| DE | 10216415 | A1 | 10/2003 |
| KR | 20040009257 | A | 1/2004 |
| KR | 20100093819 | A | 8/2010 |
| LU | 91424 | A1 | 10/2009 |
| SU | 600110 | | 3/1978 |
| WO | 2004048617 | A1 | 6/2004 |

OTHER PUBLICATIONS

International Search Report for correpsonding applcation No. PCT/EP2011/067176 filed Sep. 30, 2011; Mail date Jan. 19, 2012.
Written Opinion for correpsonding applcation No. PCT/EP2011/067176 filed Sep. 30, 2011; Mail date Jan. 19, 2012.
Leyser P., "INBA® Slag granulation system—Environmental process control", Iron and Steel Technology, vol. 2, No. 4 Apr. 1, 2005, pp. 139-146, XP009051866.

* cited by examiner

*Primary Examiner* — Scott Kastler
(74) *Attorney, Agent, or Firm* — Cantor Colburn LLP

(57) ABSTRACT

A granulation installation for a melt produced in a metallurgical plant having a water injection device for quenching and granulating the melt and a granulation tank for collecting water and granulates. The installation includes a steam condensation tower located above the granulation tank for collecting steam generated therein, where the tower has a steam condensing system. The system includes a water-spraying device disposed above a water-collecting device. The tower further includes a stack extending into the tower and configured for selectively evacuating excessive steam to the atmosphere. The stack has an inlet communicating with the lower zone of the tower and an outlet arranged to evacuate steam to the atmosphere above the tower. The stack is equipped with an obturator device for selective evacuation of steam through the stack. The installation may process an increase of 60% of slag without any risk of steam backflow in the granulation area.

20 Claims, 4 Drawing Sheets

STEAM CONDENSATION TOWER FOR A GRANULATION INSTALLATION

TECHNICAL FIELD

The present invention generally relates to a granulation installation for molten material, especially for metallurgical melts such as blast furnace slag. It relates more particularly to an improved steam condensation tower design for use in such an installation.

BACKGROUND ART

An example of a modern granulation installation of this type, especially for molten blast furnace slag, is illustrated in appended FIG. 5 that is part of a paper entitled "INBA® Slag granulation system—Environmental process control" published in Iron&Steel Technology, issue April 2005. As seen in FIG. 5, this kind of installation typically comprises: a water injection device [2] (also called blowing box), for injecting granulation water into a flow of molten material, e.g. slag that is received via a runner tip [1]. Thereby, granulation of the molten material is achieved. The installation further has a granulation tank [3] for collecting the granulation water and the granulated material and for cooling down the granules in a large water volume beneath the water injection device [2]. A steam condensation tower, typically having a cylindrical shell closed by a top cover, is located above the granulation tank for collecting and condensing steam generated in the granulation tank. In fact, due to the high temperatures of the molten material and the huge amount of quenching water required, a considerable amount of steam is typically produced by installations according to FIG. 5. To avoid pollution by simple emission of steam into the atmosphere, the steam condensation tower includes a steam condensing system, typically of the counter-current type. The steam condensing system has a water-spraying device [5] for spraying water droplets into steam that rises inside the steam condensation tower and a water-collecting device [6] located below the water injection device [5], for collecting sprayed condensing droplets and condensed steam.

Production of molten material in metallurgical processes is typically cyclic and subject to considerable fluctuations in terms of produced flow rates. For instance, during a tapping operation of a blast furnace, the slag flow rate is far from being constant. It shows peak values that may be more than four times the slag flow rate averaged over the duration of the tapping operation. Such peaks occur, occasionally or regularly, during short times, e.g. several minutes. It follows that in a typical state-of-the art water-based granulation installation, there are important fluctuations in the incoming heat flow rate due to the incoming slag, accordingly, equivalent fluctuations in the amount of steam generated over time. In order to find a suitable compromise between installation size and costs, the steam condensation capacity is often not designed to handle the full steam flow, which might be generated during peak slag flows. Overpressure relief flaps are foreseen (as seen in the top cover shown in FIG. 5) to open in such cases, in order to evacuate excessive steam to the atmosphere.

However, observation has shown that in practice, such overpressure flaps do not always reliably open at excess melt flow rates. It is theorized that steam is partially blocked from leaving through the overpressure flaps because, among others, of the "barrier" formed by the "curtain" of water constantly produced by the water injection device [2]. Possibly, at high steam rates, there is also resistance to steam flow formed by the water-collecting device [6]. Accordingly, excess steam remains inside the tower, and overpressure is subsequently generated. This can lead to partial backflow of steam at the lower inlet of the condensation tower, at the entrance of the granulation tank [3]. Although an internal hood is especially foreseen to separate the inside from the outside, and thus avoiding unwanted air to enter the tower, but also preventing steam from being blown out of the tower.

Such reverse steam flow may lead, at the very least, to bad visibility in the casthouse, which is obviously a serious safety risk for operating personnel. Much more adversely, steam blowing back through the internal hood can lead to considerable generation of low-density slag particles (so-called "popcorn") when the steam comes into contact with the liquid hot melt inside the slag runner spout. Such hot particles, when projected into the casthouse, generate an even more severe safety risk.

BRIEF SUMMARY

A steam condensation tower is herein provided, which enables more reliable evacuation of excessive steam during granulation at peak flow rates, while being compatible with existing granulation plant designs at comparatively low additional cost.

The condensation tower further enables reduction in installation and operating costs of the plant.

The present invention generally relates to a granulation installation and to a condensation tower.

In order to overcome the above-mentioned problem, the present invention proposes a kind of chimney or smokestack, hereinafter called stack, for selectively evacuating excessive steam (not flue gas) to the atmosphere. The stack according to the invention has an inlet arranged to communicate with the lower zone of the condensation tower and an outlet arranged to release steam into the atmosphere above the stack, e.g. at or above the level of the top cover of the condensation tower. Further according to the invention, in order to permit selective evacuation as desired or required, the stack is preferably equipped with any suitable device for controlling selective evacuation of steam through the stack. Suitable devices that favor or restrict evacuation may include any kind of obturator device, e.g. a specially designed "water curtain" obturator device, and/or condensation nozzles inside the stack and/or a forced draught blower or fan. Whereas the structure of the evacuation control device as such is of lesser importance, the possibility of selectively controlling evacuation of steam through the stack is very advantageous.

The proposed stack has the incontestable merit of safely evacuating any undesired and potentially harmful excess of steam and thereby considerably increasing operation safety. Moreover, the proposed stack allows designing the installation with a smaller-scale condensation system. In fact, an installation equipped with the proposed stack is capable of handling a total steam flow corresponding to a significantly higher slag flow rate, the steam flow being composed of one partial steam flow, typically of larger proportion, that is condensed in usual manner and another partial steam flow, typically of minor proportion, that is simply evacuated to the atmosphere through the proposed stack during a limited time. Hence, instead of adopting common practice of designing the entire installation for the maximum expected melt flow rate, it may be designed to handle an average nominal flow rate occurring during the majority of time during operation. Considerable savings in capital and operating expenditure are thereby enabled. As will further be appreciated, the preferred stack design avoids overpressure inside the condensation tower and, safely precludes steam from being blown back into the casthouse at higher-than-nominal flow rates. By virtue of selective evacuation only, the installation operates in conventional manner at nominal and lower-than-nominal flow rates, without steam being purposely released to the atmosphere. The proposed installation has the additional benefit of enabling a passive design (taking advantage of natural draught) that does not require an increase of water flow rates, i.e. investment and operating costs for pumps, piping, valves and the cooling tower are not increased either. Furthermore, the investment (capital expenditure) for providing the proposed stack are very low compared to increasing the capacity of the condensation system up to a comparable safety margin.

As will be understood, while not being limited thereto, the proposed installation is especially suitable for a blast furnace plant.

The invention also relates to the condensation tower as such, which may separately find industrial application as a retro-fit replacement for existing granulation installations.

BRIEF DESCRIPTION OF THE DRAWINGS

Further details and advantages of the present invention will be apparent from the following detailed description of several not limiting embodiments with reference to the attached drawings, wherein.

Identical reference signs are used throughout the drawings to identify structurally or functionally similar elements.

DESCRIPTION OF PREFERRED EMBODIMENTS

Figure 1:
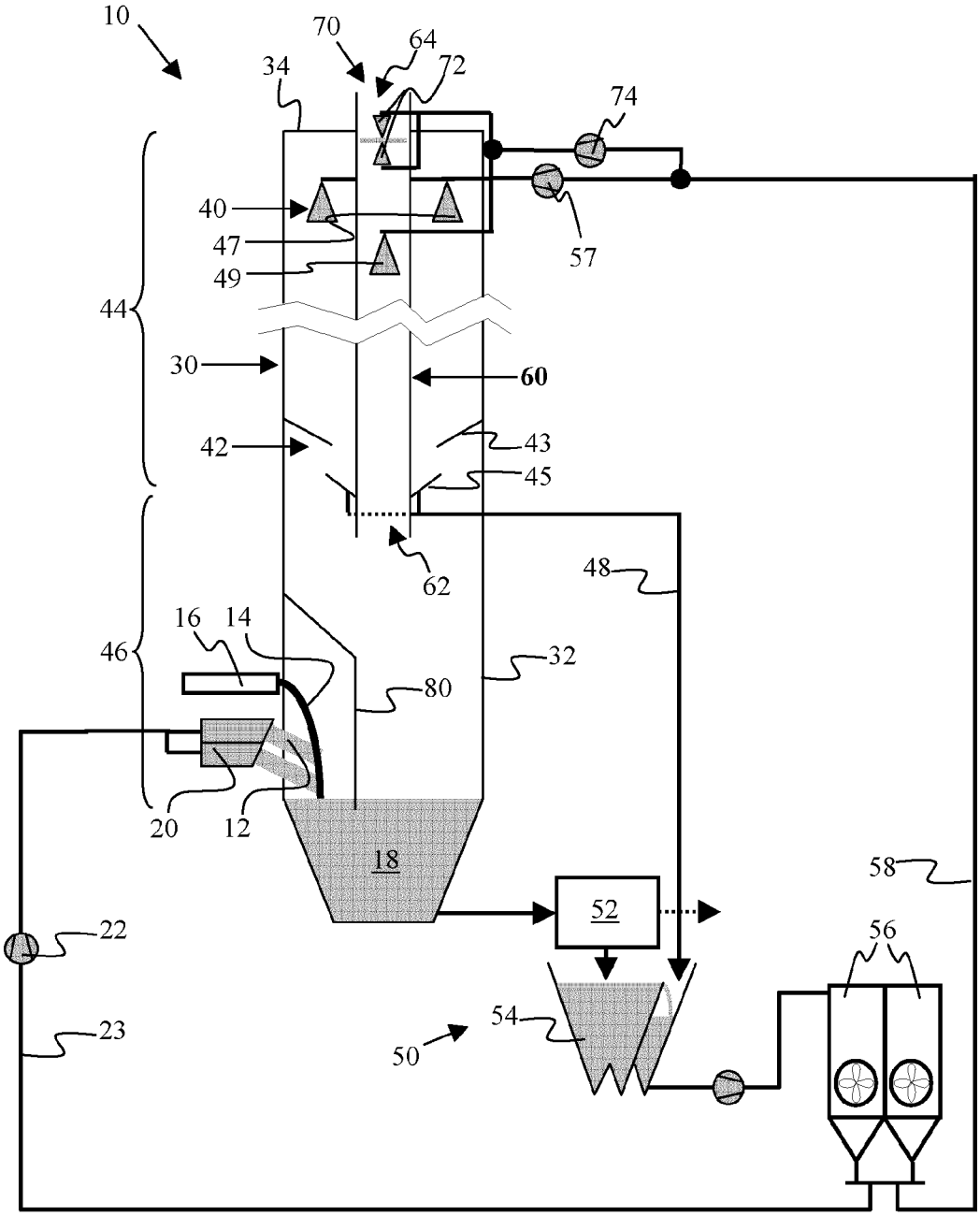
FIG. 1 is a block schematic diagram of a first embodiment of a granulation installation equipped with a steam condensation tower according to the invention.

For illustrating a first embodiment of the present invention, FIG. 1 shows a diagrammatic view of a granulation installation 10 designed for slag granulation in a blast furnace plant (the plant not being shown). Generally speaking, the installation 10 thus serves to granulate a flow of molten blast furnace slag 14 by quenching it with one or more jets 12 of comparatively cold granulation water. As seen in FIG. 1, a flow of molten slag 14, inevitably tapped with the pig iron from a blast furnace, falls from a hot melt runner tip 16 into a granulation tank 18. During operation, jets of granulation water 12, which are produced by a water injection device 20 (often also called a "blowing box") supplied by one or more parallel high-pressure pump(s) 22, impinge onto the molten slag 14 falling from the hot runner tip 16. A suitable configuration of a water injection device 20 is described e.g. in patent application WO 2004/048617. In older granulation installations (not shown, but encompassed), molten slag falls from a hot runner onto a cold runner, with jets of granulation water from a similar water injection device entraining the flow on the cold runner towards a granulation tank. Irrespectively of the design, granulation is achieved when the granulation water jets 12 impinge on the flow of molten slag 14.

By virtue of quenching, the molten slag 14 breaks up into grain-sized "granules", which fall into a large water volume maintained in the granulation tank 18. These slag "granules" completely solidify into slag sand by heat exchange with water. It may be noted that the jets of granulation water 12 are directed towards the water surface in the granulation tank 18, thereby promoting turbulence that accelerates cooling of the slag.

As is well known, quenching of an initially hot melt (>1000° C.) such as molten slag results in important quantities of steam (i.e. water vapor). This steam is usually contaminated, among others, with gaseous sulfur compounds. In order to reduce atmospheric pollution, steam released in the granulation tank 18 is routed into a steam condensation tower 30 that is typically located vertically above the granulation tank 18. This steam condensation tower 30 (hereinafter in short "tower 30") is equipped with a steam condensing system, usually of the counter-current type, that includes a water-spraying device 40 and a water-collecting device 42. As seen in FIG. 1, the tower 30 is a comparatively large edifice that has an external shell 32. The shell 32, which is typically but not necessarily a cylindrical welded steel plate construction, is provided with a top cover 34. The tower 30 has a certain height and diameter dimensioned for a nominal volume of emitted steam. As schematically illustrated in FIGS. 2A-B&3A-B, the tower 30 may have a reservoir with emergency water at its top cover 34.

The water-spraying device 40 is usually located near the top cover 34 of the tower 30 for maximum effect. It includes a plurality of water-spraying nozzles 47, 49 for spraying water droplets into steam and vapors that rise inside the tower 30. The water-spraying device 40 serves steam condensation and additionally improves dissolution of harmful vapors.

The water-collecting device 42 is arranged inside the tower 30 at a vertical distance of several meters below the water-spraying device 40. The water-collecting device 42 can be seen to divide the tower 30 into a virtual upper zone 44, in which steam condenses during operation, and into a virtual lower zone 46. During operation steam rises from the granulation tank 18, through the lower zone 46 and through the water-collecting device 42, into the upper zone 44. Typically, the upper zone 44 occupies a significantly larger height proportion than the lower zone 46. Zigzag lines in FIG. 1 indicate that the full height of the tower 30 is not shown, i.e. that the vertical distance between the water-spraying device 40 and the water-collecting device 42 is typically greater than illustrated in FIG. 1.

The water-collecting device 42 is configured to collect the falling droplets, resulting from the sprayed droplets and condensed steam. The water-collecting device 42 thereby prevents water from falling back into the granulation tank 18 and permits recovery of comparatively clean process water by way of a drainage conduit 48. For this purpose, the water-collecting device 42 can include at least one funnel-shaped or cup-shaped upper collector 43 and a lower funnel-shaped collector 45, as schematically represented in FIG. 1. In this case, several circumferentially distributed openings between the collectors 43, 45 allow steam and vapors to rise from the lower zone 46 into the upper zone 44 of the tower 30. To minimize flow resistance offered to the steam, the distributed openings between the collectors 43, 45 preferably have a height of at least 500 mm. Other designs of a water-collecting device 42 are possible and encompassed.

As seen in FIG. 1, at the bottom of the granulation tank 18, solidified slag sand mixed with granulation water is evacuated. The mixture (slurry) is fed to a dewatering unit 50. The purpose of this dewatering unit 50 is to separate granulated material (i.e. slag sand) from water, i.e. to enable separate recovery of slag sand and process water. A suitable general configuration of a dewatering unit 50 is well known from existing INBA® installations or described e.g. in U.S. Pat. No. 4,204,855 and thus not further detailed here. Such a dewatering unit comprises a rotary filtering drum 52, e.g. as described in more detail in U.S. Pat. No. 5,248,420. Any other static or dynamic device for dewatering fine solidified melt granules may also be used. As further shown in FIG. 1, a granulation water recovery tank 54 (often called a "hot water tank") is associated with the dewatering unit 50 for collecting water that is separated from the granulated slag sand. In most cases, this water recovery tank 54 is conceived as a settling tank with a settling compartment and a clean water compartment (seen to the right in FIG. 1), into which the largely sand-free ("clean") water overflows.

As also appears from FIG. 1, the drainage conduit 48 of the water-collecting device 42 can be connected to feed condensed and sprayed water from tower 30 into the water recovery tank 54. It may also be pumped directly to a cooling system 56 or be used for other purposes, e.g. to feed the injection device(s) 20, or simply be discarded. In the variant shown in FIG. 1, the drainage conduit 48 debouches into the clean water compartment of the water recovery tank 54. From this compartment largely solids-free water is pumped to a cooling system 56 that has one or more cooling towers. Cooled process water from the cooling system 56 is fed back to the granulation installation 10 for reuse in the process. More specifically, cold water is preferably fed, on the one hand, to the water injection device 20 via one supply conduit 23 and, on the other hand, to the water-spraying device 40 via another supply conduit 58. The supply conduit 23 is equipped with the aforementioned pump(s) 22. The supply conduit 58 in turn is equipped with at least one pump 57, or preferably two parallel pumps, that belong to the water-spraying device 40. Accordingly, the water-spraying nozzles 47, 49 of the water-spraying device 40 are supplied with re-circulated cold water from the cooling system 56 via the supply conduit 58. Whereas such a "closed-circuit" configuration for process water is preferred, open-circuit alternatives are also encompassed, with water supplied to the water-spraying nozzles 47, 49 and or the injection device(s) 20 being disposed after use.

According to an aspect to be appreciated, the tower 30 according to the invention is equipped with a stack 60 for evacuating excessive steam to the atmosphere. The stack 60, as schematically illustrated in FIG. 1, is a kind of steam-evacuating chimney that is operatively associated to the tower 30. More specifically, the stack 60 illustrated in FIG. 1 has a lower inlet 62 arranged to communicate with the lower zone 46 and an upper outlet 64 arranged approximately at or slightly above the level of the top cover 34 of the tower 30. The stack 60 is further equipped with a device for controlling selective evacuation of steam through the stack 60. In the embodiment of FIG. 1, this device includes an obturator device 70 for controlling selective evacuation of steam from the lower zone 46, through the stack 60, into the atmosphere above the outlet 64. Accordingly, the stack 60 serves as a controllable chimney for controlled evacuation of steam to the atmosphere. Specifically, as will become more apparent below, the stack 60 enables evacuation of amounts of steam in excess of the condensation capacity of the tower 30.

Figure 5:
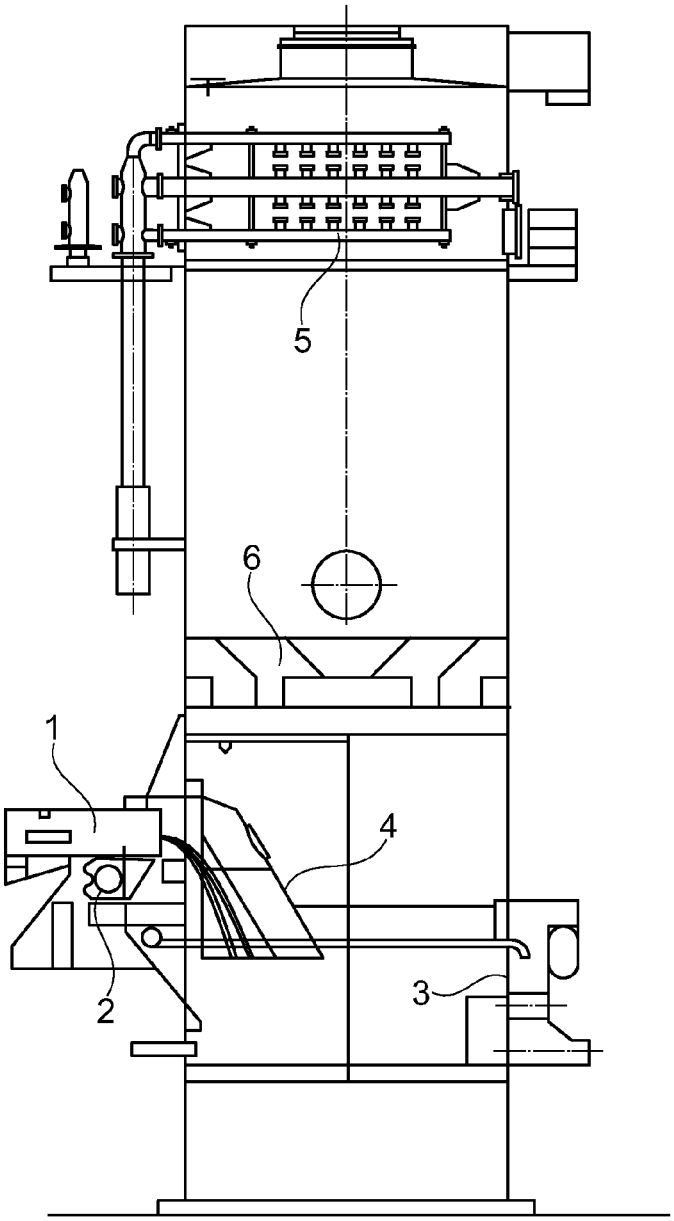
Fig. 5 PRIOR ART
FIG. 5 illustrates a known granulation installation according to prior art.

In a conventional system, as illustrated in FIG. 5, whenever melt flow rates exceed the capacity of the tower 30, experience has shown a severe risk of backflow (reverse flow) of steam, e.g. into the hot runner and even into the casthouse (not shown) upstream of the runner tip 16. Even with overpressure flaps in the top cover 34 and with an internal hood 80, as illustrated in FIG. 1, achieving a certain resistance against backflow, backflow can still occur. In known manner, the internal hood 80 (also shown in FIG. 5) is provided mainly for sealing the tower 30 against entry of "false" ambient air.

Contrary to such conventional design, the proposed stack 60 provides a reliable solution for safely evacuating excess steam whenever flow rates exceed the nominal capacity of the tower 30. As will be understood, such excess flow rates may occur accidentally, e.g. in case of molten slag peaks because of a problem at the taphole of the blast furnace. As will be appreciated, by virtue of the present invention, designs with lower plant capacity in terms of steam condensation can be considered. In fact, with a nominal capacity designed to be less than the expected short-term flow rate peaks, i.e. contrary to accepted design practice (with nominal capacity corresponding to expected peak flow) a tower 30 equipped with a stack 60 may still reliably operate.

In view of optimum chimney draft (draught) with a passive stack 60 of a given diameter, the stack 60 has its inlet arranged below the collectors 43, 45 of the water-collecting device 42 so that the inlet 62 communicates directly with the lower zone 46. In other words, the stack 60 extends from underneath the collecting device 42, through the upper zone 44, into or through an opening in the top cover 34. With the inlet 62 situated below the funnel-shaped collectors 43, 45, draught generated by the stack 60 enables steam to be directly evacuated out of the lower zone 46, i.e. evacuated from where it is generated (directly above the granulation water surface). Accordingly, in addition to optimum draught, overpressure in the lower zone 46, as a main source of the aforementioned risk, can be avoided by the proposed configuration of the stack 60. Moreover, no water droplets from the water-spraying device 40 are sucked in through the lower inlet 62 as water is still properly collected by water-collecting device 42.

Whereas an externally arranged stack (not shown), e.g. fixed to the outside of the shell 32, is encompassed and possible an internal stack 60 inside the tower 30 is preferred. Among others, the latter configuration takes advantage of the shell 32 as a windshield for the stack 60. For constructional reasons, a single stack 60 of comparatively large diameter is preferably arranged centrally inside the shell 32 as shown in FIG. 1. Less preferred arrangements, e.g. two diametrically opposite smaller stacks, are also possible and encompassed. In order to achieve additional draught, the stack 60 may slightly protrude beyond the top cover 34. Despite sacrificing potential supplementary draught it is also beneficial for constructional reasons if the outlet 64 of the stack 60 does not significantly extend above the shell 32, i.e. beyond the level of the top cover 34. In practice it should not extend above the top cover 34 by more than 15% of the total height h (see FIG. 3A) of the stack 60. With an arrangement as shown in FIG. 1, the stack 60 can be readily supported by the structure of the external shell 32 and/or, if desirable, partially or fully suspended to the structure of the top cover 34. Accordingly there is no need for additional bearing structure or a considerable wall-thickness of the stack 60.

As will be understood, appropriate dimensioning of the diameter d (see FIG. 3A) and the height h (see FIG. 3A) of the stack 60 determines the amount of steam that can be safely evacuated through the stack 60 into the atmosphere (without overpressure in the lower zone 46 of the tower 30 and the related risk of steam backflow). For a stack 60 designed to be passive, i.e. to function purely due to natural draught, an internal diameter d≥400 mm is normally required. In practice, with stack heights h typically in the range of 10-25 m, preferably in the range of 15-20 m, optimum results can be achieved with diameters d respecting a ratio $0.055 \leq d/h \leq 0.25$, preferably in the range of $0.1 \leq d/h \leq 0.2$. In case of an installation 10 designed for blast furnace slag, a corresponding stack 60 readily achieves natural draught capable of evacuating steam generated by extra slag in the order of 3-4 t/min (excess flow rate). By virtue of the stack 60, the installation 10 can thus safely operate at slag flow rates higher than the maximum condensation capacity of the tower 30. For instance, it may operate at peak slag flow rates of 11-12 t/min with a tower 30 designed for condensing steam generated by melt flow rates of only 8 t/min. As will be appreciated, a stack 60 according to the invention thereby allows processing capacity increases of up to 50% while also increasing the safety of operation. As will be understood, a stack (not shown) with $d/h<0.1$ or even $d/h<0.055$ is also possible. However such a configuration is much less preferred and typically requires equipping such a smaller-diameter stack (not shown) with a motorized exhaust blower for warranting sufficient suction i.e. artificial draught and related risk of failure.

In order to warrant efficient condensation and minimum pollution at usual flow rates below peak values, the stack 60 of FIG. 1 is equipped with the aforementioned controllable obturator device 70. This obturator device 70 serves to "shut-off" the stack 60, i.e. to close or at least significantly restrict steam passage between the inlet 62 and the outlet 64 whenever the granulation installation 10 operates at or below nominal flow rates, especially with steam generated at or below the condensation capacity of the tower 30. In other words, the obturator device 70 is used to evacuate steam through the stack 60 selectively only when required or desired in function of the actually generated steam quantity.

The obturator device 70 may be arranged slightly below the upper outlet 64 of the stack 60 and, preferably, in the upper half of the stack 60. In a simple embodiment, the obturator device 70 may include a simple motor-actuated movable plate (not shown) for shutting the passage through the stack 60. For instance, a hinged flap or a butterfly disc can be arranged on top of or inside the stack 60 e.g. at the outlet 64. However, in a preferred configuration as illustrated in FIGS. 1-4, the obturator device 70 is not a conventional valve, but configured to create a controllable "water curtain" serving as obturator. In a preferred embodiment, the obturator device 70 comprises coaxially facing water jet nozzles 72 that are arranged inside the stack 60 for creating the water curtain therein. The facing water jet nozzles 72 are preferably arranged centrally inside the stack 60. A suitable concept for facing water jet nozzles 72 is generally known from a conventional design according to FIG. 5 or e.g. from German patent DE 3,619,857. Such facing water jet nozzles 72 generate a film-like "curtain", "wall" or "cap" of water that has been found to cause considerable resistance to steam passage. Additionally, this design of the obturator device 70 has the benefits of favoring steam condensation and automatically opening the passage through the stack 60 in case of water or power shortage. Hence, the proposed obturator device 70 provides additional operational safety. Therefore, the water jet nozzles 72 are preferably supplied via the same supply conduit 58 that feeds water to the water-spraying device 40. Operation of the obturator device 70 may be controlled via operation of an additional obturator pump 74 and on the basis of any appropriate flow rate (e.g. slag flow rate) or excess steam measurement, e.g. a thermal balance calculation or other measurements indicative of actual flow rate of melt received via the runner tip 16.

As will be understood, in addition to the presence of a stack 60 with a controllable obturator device 70, several per se typical components of a tower 30 according to the invention have been redesigned.

Firstly, the safety flaps at the upper top cover 34 may be reduced in number or completely omitted when using a stack 60 with a passage restriction based on a "water curtain" type obturator device 70. As seen in FIG. 1, the water-collecting device 42 also requires redesign. In one possible embodiment, the lower funnel-shaped collector 45 is arranged in disk-like manner concentrically around a lower portion of the stack 60 and may be supported by the stack 60. The upper funnel-shaped collector 43 has a central opening that is smaller in diameter than the outer diameter of the lower funnel-shaped collector 45 so as to prevent droplets from falling back into the granulation tank 18. Flow resistance through the passages between the collectors is minimized, e.g. by means of openings having a sufficiently large free cross-section. Other designs are also possible, e.g. with several outwardly sloping discs having a diameter increasing radially outwards, as shown in FIGS. 2A&3A for instance.

The arrangement and the type of water-spraying nozzles 47, 49 of the water-spraying device 40 have also been adapted in view of the stack 60. In particular, as best seen in FIGS. 2B&3B, a plurality of water-spraying nozzles 47 is arranged in circular symmetry around the stack 60 for spraying water droplets into the upper zone 44 of the tower 30. Several horizontal rows of nozzles, typically one to four rows, e.g. two rows as illustrated in FIGS. 2A&3A, may be provided at different heights in the upper zone 44 of the tower 30. Preferably, the water-spraying nozzles 47 are individual (non-facing) nozzles of the so-called full-cone type. The nozzles 47 are thus individually arranged to create an unrestricted spray (contrary to the coaxially facing type of FIG. 5), which may be oriented downwardly or slightly sideways. As an additional benefit, such nozzles 47 operate at lower pressure than those of a water-spraying device shown in FIG. 5, e.g. at only 1-1.5 bar.

Figure 2A:
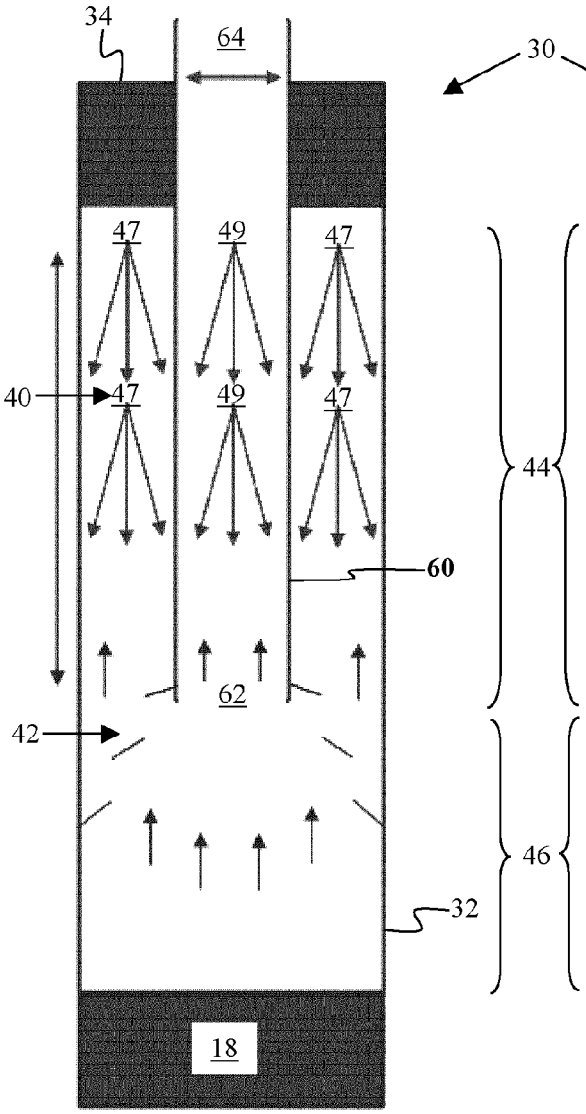
FIGS. 2A-B illustrate, in schematic vertical and horizontal section, a steam condensation tower at normal operation below peak flow rates of molten material.
Figure 3A:
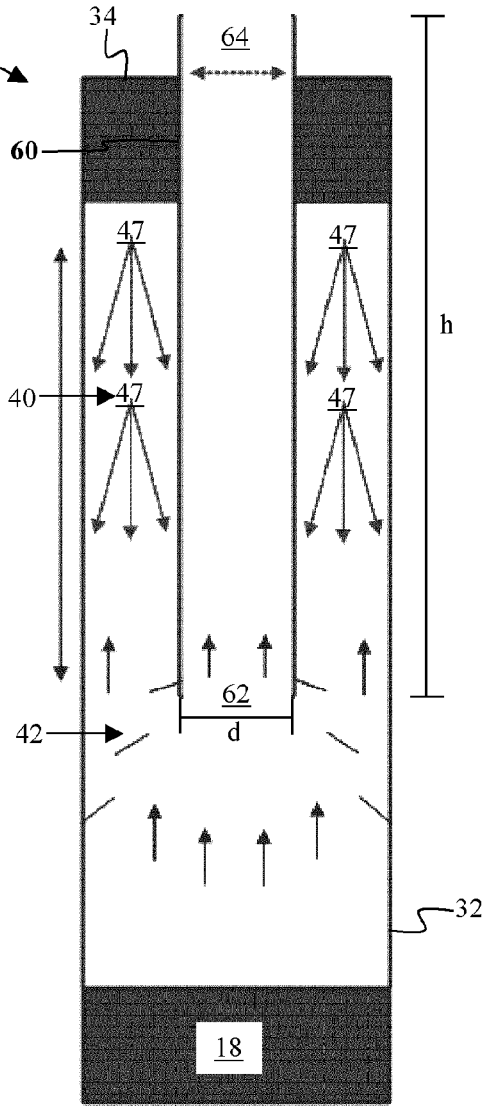
FIGS. 3A-B illustrate, in schematic vertical and horizontal section, the steam condensation tower with steam evacuation through a stack at peak flow rates of molten material.
Figure 2B:
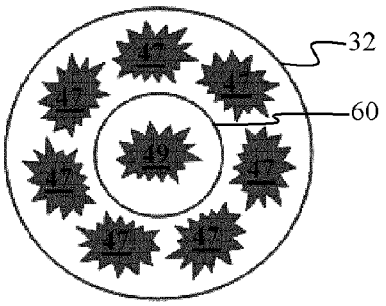
Figure 3B:
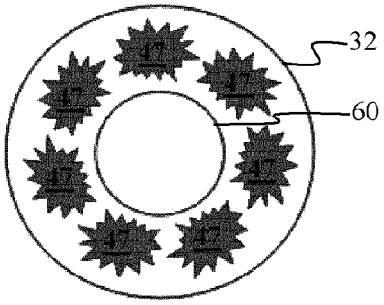

FIGS. 2A&2B illustrate operation of the proposed tower 30 at normal flow rates of the melt, i.e. below peaks. FIGS. 3A&3B in turn illustrate the state of selective evacuation of steam through the stack 60, i.e. operation with excessive steam generation. As further seen in FIGS. 2B&3B, the proposed tower 30 comprises one or more vertically spaced water-spraying nozzles 49 arranged inside the stack 60, preferably centrally therein, e.g. on the coaxial central axes of the stack 60 and tower 30. These water-spraying nozzles 49 as such are preferably of the same type as the water-spraying nozzles 47 outside the stack 60. As seen in FIGS. 3A&3B as opposed to the external water-spraying nozzles 47 the nozzles 49 internal to the stack 60 are shut-off during excessive flow rates to warrant unrestricted passage for excess steam through the stack 60. This shut-off enables maximum evacuation flow rate and avoids evacuating water droplets together with steam. As will be appreciated, operating water-spraying nozzles 49 inside the stack 60 has the notable benefit of improving the overall condensation efficiency of the water-spraying device 40. In fact, the whole cross-section of the tower 30, including the space occupied by the stack 60 within the upper zone 44, (which may represent a considerable proportion) is still used for condensation by virtue of the internal water-spraying nozzles 49. In a simple configuration, the water-spraying nozzles 49 operating inside the stack 60 are connected to the same supply line that feeds the "water curtain" obturator device 70, e.g. downstream of obturator pump 74. Accordingly, supply of the nozzles 49 is shut-off when the obturator device 70 is in an inactive "open" state. On the other hand, whenever the obturator device 70 is active i.e. in "closed" state, the water-spraying nozzles 49 operate. As a beneficial side-effect, the operating water-spraying nozzles 49 further increase flow resistance through the stack 60. For proper co-operation, the water-spraying nozzles 49 inside the stack 60 are arranged below the level of the obturator device 70. Accordingly, the internal water-spraying nozzles 49 can be seen to form part of the device or arrangement for controlling selective evacuation of steam through the stack. However, with a smaller diameter of stack and/or a larger diameter of the shell, there may be no internal nozzles. Whereas not necessary, it may also be envisaged to further include a forced draught blower or fan for increased forced draught in the device for controlling evacuation, e.g. in case of exceptionally high flow rates.

Figure 4:
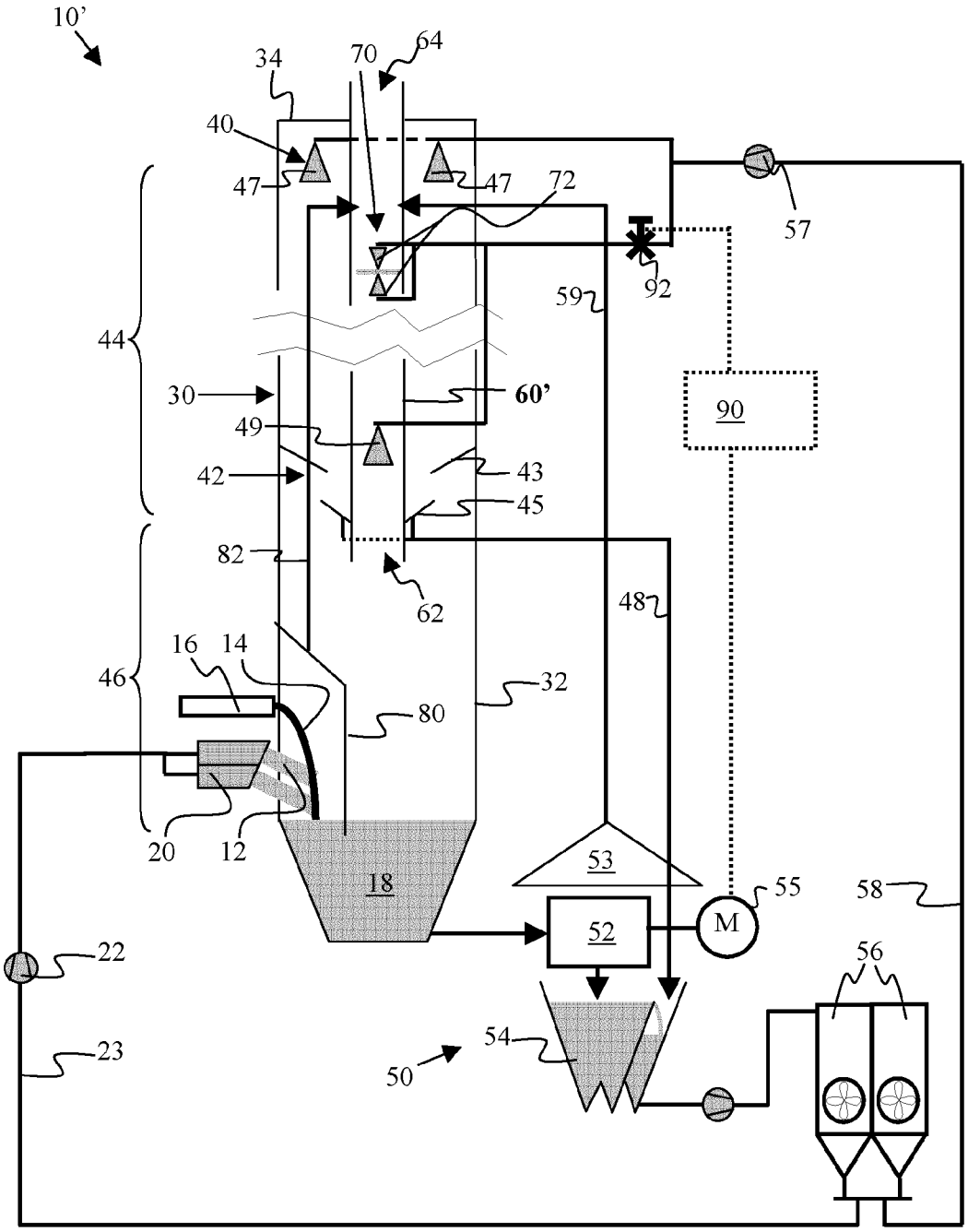
FIG. 4 is a block schematic diagram of a second embodiment of a granulation installation equipped with a steam condensation tower according to the invention.

FIG. 4 illustrates a granulation installation 10' with a modified stack 60' according to a second preferred embodiment. Only differences with respect to the preceding embodiment will be detailed below, other features being equivalent.

As seen in FIG. 4, the obturator device 70, whilst also comprising coaxially facing nozzles 72 to create a "water curtain", is arranged at the lower part of the upper half of the stack 60', e.g. at 60% of the height h. This configuration enables the stack 60' to serve additional evacuation purposes. In particular, as schematically illustrated in FIG. 4, the dewatering unit 50 has a steam collection hood 53 above the dewatering drum 52, which is connected to the stack 60' above the obturator device 70. Accordingly, a first auxiliary conduit 59 has its intake end connected to the steam collection hood 53 and its exhaust entering the internal stack 60' at a level slightly above the obturator device 70. Accordingly, steam from the dewatering unit 50 is sucked off, without additional energy loss, from the steam collection hood 53 to the stack 60', even when the obturator device 70 restricts passage for steam from the lower zone 46 of the tower 30, i.e. at normal flow rates. This configuration has the benefit of properly evacuating steam from the dewatering unit 50 and releasing the steam at a higher elevation than usual, e.g. 25-30 m above ground, thus reducing visibility problems in the surroundings of the dewatering unit 50 and the installation 10' in general. Similarly, as schematically illustrated in FIG. 4, a second auxiliary conduit 82 is connected with its intake to the internal hood 80 and with its exhaust to the stack 60' at a level above the obturator device 70. This measure transforms the internal hood 80 into an extraction hood. A certain draught is created in the space delimited by the internal hood 80 above the hot runner tip 16 and the jets 12. This measure provides additional safety, by avoiding backflow of that fraction of steam that is generated by the jets 12 into the runner and into the casthouse.

As further shown in FIG. 4, the stack 60', in particular its controllable obturator device 70 and the internal nozzles 49 are connected to a controller 90, which can be integrated into the process control system of the entire plant. The controller 90 operates a remote controllable automatic valve 92 connected to the outlet of the pump 57 that feeds the water-spraying device 40. Accordingly, by controlling opening and closure of the valve 92, the controller indirectly controls operation of the obturator device 70 so as to selectively restrict or permit steam passage through the stack 60'. In the preferred arrangement the spraying nozzle(s) 49 arranged inside the stack 60' are connected to the supply line of the obturator device downstream of the valve 92. Accordingly, the valve 92 and controller 90 also control operation the internal spraying nozzle(s) 49 without additional expense. As a reading for measuring the actual flow rate of melt, and thereby conclude on the quantity of steam generated inside the tower 30 above the granulation tank 18, the controller 90 may be connected to the drum motor 55 that rotates the dewatering drum 52. In fact, the torque required to rotate the drum 52 is indicative of the flow rate of slurry received by the dewatering unit 50 and, consequently, of the quantity of steam generated in the lower zone 46 of the tower 30. Other possibilities of measuring a value indicative of generated steam, e.g. thermal balance calculations, are of course also encompassed.

In conclusion, it will be appreciated that the present invention not only enables an important increase in operational safety of a water-based granulation installation 10, especially for blast furnace slag. In addition, the invention permits reliable operation at reduced condensation capacity and thus at lower capital and operating expenditure. In fact, in case of a blast furnace slag granulation installation, it is projected that a granulation installation 10 with the proposed stack 60; 60' is capable of reliably processing an excess of steam that corresponds to an increase of slag flow of up to +60%. This may represent an increase of for instance around +5 t/min (83.33 kg/s) of slag in a system having a condensation capacity designed to handle a maximum slag flow rate of 8 t/min (133.33 kg/s).

The invention claimed is:

1. A granulation installation for granulating molten material produced in a metallurgical plant, said installation comprising:

a water injection device, for injecting granulation water into a flow of molten material and thereby granulating the molten material;

a granulation tank for collecting the granulation water and the granulated material;

a steam condensation tower located above said granulation tank, for collecting steam generated in said granulation tank, said steam condensation tower having an external shell with a top cover and a steam condensing system that includes a water-spraying device for spraying water droplets into said steam condensation tower, and a water-collecting device located in said steam condensation tower below said water-spraying device, for collecting sprayed water droplets and condensed steam;

said collecting device dividing said tower into an upper zone, in which steam can condense, and a lower zone through which steam can rise from said granulation tank into said upper zone;

the installation further comprising a stack having at least a portion thereof extending into said steam condensation tower and configured for selectively evacuating excessive steam to the atmosphere, said stack having an inlet arranged to communicate with said lower zone of said condensation tower and an outlet arranged to release steam at or above the level of said top cover of said condensation tower.

2. The granulation installation as claimed in claim 1, wherein said stack is equipped with a device for controlling selective evacuation of steam through said stack, with an obturator device; and/or at least one internal spraying nozzle arranged inside said stack for spraying water droplets into said stack; and/or a blower for creating forced draught through said stack.

3. The granulation installation as claimed in claim 1, wherein said stack extends from underneath said collecting device into or through an opening in said top cover.

4. The granulation installation as claimed in claim 1, wherein said stack is arranged inside said condensation tower.

5. The granulation installation as claimed in claim 4, wherein said stack is arranged centrally inside said condensation tower so that that said outlet of said stack does not extend above the level of said top cover by more than 15% of the total height of the stack.

6. The granulation installation as claimed in claim 4, wherein said stack is supported by said external shell and/or said top cover of said condensation tower.

7. The granulation installation as claimed in claim 2, wherein said obturator device comprises:

coaxially facing water jet nozzles for creating a water curtain inside said stack, said facing water jet nozzles being arranged centrally inside said stack; and/or a movable plate.

8. The granulation installation as claimed in claim 2, wherein said water-spraying device comprises several water-spraying nozzles for spraying water droplets into said steam condensation tower and at least one internal spraying nozzle arranged inside said stack for spraying water droplets into said stack below said obturator device.

9. The granulation installation as claimed in claim 2, further comprising a dewatering unit with a rotary filtering drum, having a steam collection hood and wherein a first auxiliary conduit is connected at an intake end to said steam collection hood and at an exhaust end to said stack at a level above said obturator device.

10. The granulation installation as claimed in claim 2, further comprising an internal hood, which extends into said granulation tank in order to seal said condensation tower against entry of ambient air, and wherein an second auxiliary conduit is connected at an intake end to said internal hood and at an exhaust end to said stack at a level above said obturator device.

11. The granulation installation as claimed in claim 1, further comprising a controller device that is connected:

to operate an obturator device so as to selectively restrict or permit steam passage through said stack; and/or to control operation of at least one spraying nozzle arranged inside said stack.

12. The granulation installation as claimed in claim 1, wherein said stack has a height in the range of 10-25 m.

13. The granulation installation as claimed in claim 12, wherein said stack has a ratio between internal diameter and height of said stack in the range of $0.055 \leq d/h \leq 0.25$.

14. The granulation installation as claimed in claim 2, wherein said device for controlling selective evacuation comprises an obturator device and at least one internal spraying nozzle arranged inside said stack for spraying water droplets into said stack; and said stack is configured for natural draught.

15. The granulation installation as claimed in claim 2, wherein said stack has a ratio between internal diameter and height of said stack of $d/h \leq 0.1$.

16. The granulation installation as claimed in claim 15, wherein said device for controlling selective evacuation comprises a blower for creating forced draught through said stack.

17. The granulation installation as claimed in claim 1, wherein said collecting device comprises one or more funnel-shaped collectors communicating with a drainage conduit for recovering process water.

18. The granulation installation as claimed in claim 17, wherein said collecting device comprises an upper funnel-shaped collector and a lower funnel-shaped collector, said lower funnel-shaped collector being arranged concentrically around a lower portion of said stack, said upper funnel-shaped collector having a central opening that is smaller in diameter than the outer diameter of said lower funnel-shaped collector.

19. Blast furnace plant comprising a granulation installation as claimed in claim 1.

20. A steam condensation tower for use in a granulation installation according to claim 1, said tower being configured for collecting steam generated in a granulation tank and having an external shell with a top cover and a steam condensing system that includes a water-spraying device for spraying water droplets into said steam condensation tower, and a water-collecting device located in said steam condensation tower below said water-spraying device, for collecting sprayed water droplets and condensed steam;

said collecting device dividing said tower into an upper zone, in which steam can condense, and a lower zone through which steam can rise from said granulation tank into said upper zone;

and a stack having at least a portion thereof extending into said steam condensation tower and configured for selectively evacuating excessive steam to the atmosphere, said stack having an inlet arranged to communicate with said lower zone of said condensation tower and an outlet arranged to release steam at or above the level of said top cover of said condensation tower.

* * * * *